US006819040B2

(12) United States Patent
Parsapour et al.

(10) Patent No.: US 6,819,040 B2
(45) Date of Patent: Nov. 16, 2004

(54) CATHODE RAY TUBE HAVING AN INTERNAL NEUTRAL DENSITY FILTER

(75) Inventors: Farzad Parsapour, Reading, PA (US); Bhanumurthy Venkatrama Subrahmanya Gunturi, Lancaster, PA (US); Steven Anthony Colbert, Lancaster, PA (US); Brian Thomas Collins, Lititz, PA (US)

(73) Assignee: Thomson Licensing S. A., Boulogne-Billancourt (FR)

( * ) Notice: Subject to any disclaimer, the term of this patent is extended or adjusted under 35 U.S.C. 154(b) by 23 days.

(21) Appl. No.: 10/375,416

(22) Filed: Feb. 27, 2003

(65) Prior Publication Data

US 2004/0169455 A1 Sep. 2, 2004

(51) Int. Cl.[7] ..... H01J 29/88
(52) U.S. Cl. ..... 313/479; 313/466
(58) Field of Search ..... 313/110, 112, 313/479, 473, 474, 466, 477 R; 430/27

(56) References Cited

U.S. PATENT DOCUMENTS 4,521,524 A * 6/1985 Yamashita ..... 501/64
5,160,375 A * 11/1992 Otaki ..... 106/475
5,627,429 A * 5/1997 Iwasaki ..... 313/474
6,366,012 B1 * 4/2002 Lee et al. ..... 313/466

* cited by examiner

*Primary Examiner*—Vip Patel
*Assistant Examiner*—Glenn D. Zimmerman
(74) *Attorney, Agent, or Firm*—Joseph S. Tripoli; Harvey D. Fried; Richard LaPeruta, Jr.

(57) ABSTRACT

A composition and method of forming an internal neutral density filter on a luminescent screen assembly of a cathode ray tube (CRT) is disclosed. The luminescent screen assembly is formed on an interior surface of a glass faceplate panel of the CRT tube. The luminescent screen assembly includes a patterned light-absorbing matrix that defines three sets of fields corresponding to one of a blue region, a green region and a red region. An internal neutral density filter is formed on the light-absorbing matrix. An array of blue, green and red color phosphors is formed on the internal neutral density filter corresponding to one of the blue region, the green region and the red region defined in the light-absorbing matrix. The internal neutral density filter has a composition including a red pigment, a blue pigment and at least one non-pigmented oxide particle.

8 Claims, 5 Drawing Sheets

CATHODE RAY TUBE HAVING AN INTERNAL NEUTRAL DENSITY FILTER

BACKGROUND OF THE INVENTION

1. Field of the Invention

This invention relates to a color cathode ray tube (CRT) and, more particularly to a luminescent screen assembly including an internal neutral density filter.

2. Description of the Related Art

A color cathode ray tube (CRT) typically includes an electron gun, an aperture mask, and a screen. The aperture mask is interposed between the electron gun and the screen. The screen is located on an inner surface of a faceplate of the CRT tube. The aperture mask functions to direct electron beams generated ir the electron gun toward appropriate color-emitting phosphors on the screen of the CRT tube.

The screen may be a luminescent screen. Luminescent screens typically have an array of three different color-emitting phosphors (e.g., green, blue and red) formed thereon. Each of the color-emitting phosphors is separated from another by a matrix line. The matrix lines are typically formed of a light absorbing black, inert material.

The faceplate of the CRT tube typically comprises a glass panel having a low transmission coefficient. However, the use of a glass panel with a low transmission coefficient may cause the CRT tube to exhibit a "Halo" effect, which is manifested by a reflection gradient from the perimeter to the center of the panel. As a result of this reflection gradient, the perimeter of the faceplate of the CRT undesirably appears darker than the center, when the tube is off.

Thus, a need exists for a luminescent screen that overcomes the above drawbacks.

SUMMARY OF THE INVENTION

The present invention relates to a composition and method of forming an internal neutral density filter on a luminescent screen assembly of a cathode ray tube (CRT). The luminescent screen assembly is formed on an interior surface of a glass faceplate panel of the CRT tube. The luminescent screen assembly includes a patterned light-absorbing matrix that defines three sets of fields corresponding to one of a blue region, a green region and a red region. An internal neutral density filter is formed on the light-absorbing matrix. An array of blue, green and red color phosphors are then formed on the internal neutral density filter corresponding to one of the blue region, the green region and the red region defined in the light-absorbing matrix.

The internal neutral density filter has a composition including a red pigment, a blue pigment and at least one non-pigmented oxide particle. The internal neutral density filter functions to decrease the reflection of the screen throughout the panel while eliminating the "Halo" effect of the CRT tube.

BRIEF DESCRIPTION OF THE DRAWINGS

The invention will now be described in greater detail, with relation to the accompanying drawings, in which.

DETAILED DESCRIPTION OF THE INVENTION

Figure 1:
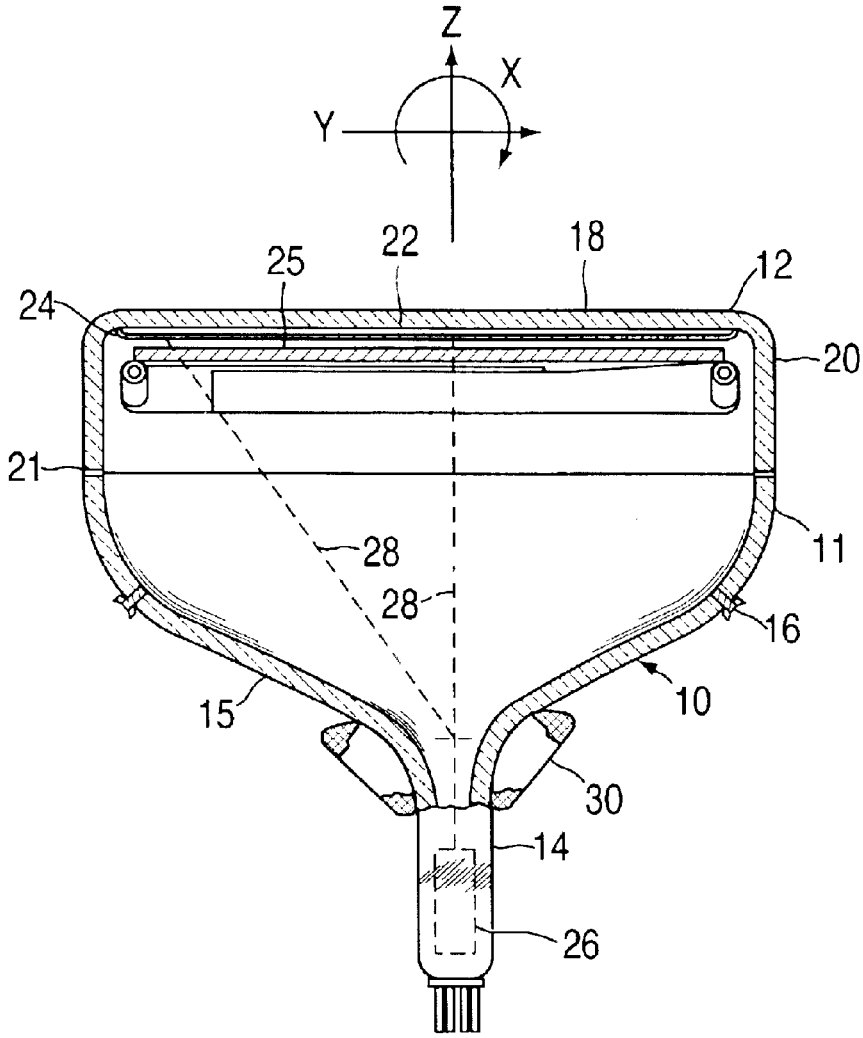
FIG. 1 is a side view, partly in axial section, of a color cathode ray tube (CRT) made according to embodiments of the present invention.

FIG. 1 shows a conventional color cathode ray tube (CRT) 10 having a glass envelope 11 comprising a faceplate panel 12 and a tubular neck 14 connected by a funnel 15. The funnel 15 has an internal conductive coating (not shown) that is in contact with, and extends from, an anode button 16 to the neck 14.

Figure 2:
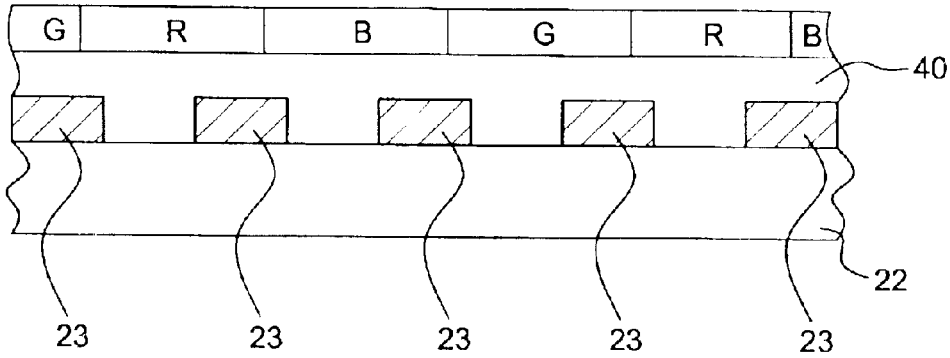
FIG. 2 is a section of the faceplate panel of the CRT of FIG. 1, showing a luminescent screen assembly including an internal neutral density filter.

The faceplate panel 12 comprises a viewing surface 18 and a peripheral flange or sidewall 20 that is sealed to the funnel 15 by a glass frit 21. A three-color luminescent phosphor screen 22 is carried on the inner surface of the faceplate panel 12. The screen 22, shown in cross-section in FIG. 2, is a line screen which includes a multiplicity of screen elements comprised of red-emitting, green-emitting, and blue-emitting phosphor stripes R, G, and B, respectively, arranged in triads, each triad including a phosphor line of each of the three colors. The R, G and B phosphor stripes extend in a direction that is generally normal to the plane in which the electron beams are generated. The R, G and B phosphor stripes are formed on an internal neutral density filter 40. The internal neutral density filter 40 comprises a blend of red pigment, blue pigment and at least one non-pigmented oxide particle.

A light-absorbing matrix 23, formed beneath the internal neutral density filter 40, separates each of the phosphor lines. A thin conductive layer 24 (shown in FIG. 1), preferably of aluminum, overlies the screen 22 and provides means for applying a uniform first anode potential to the screen 22, as well as for reflecting light, emitted from the phosphor elements, through the viewing surface 18. The screen 22 and the overlying aluminum layer 24 comprise a screen assembly.

A multi-aperture color selection electrode, or shadow mask 25 (shown in FIG. 1), is removably mounted, by conventional means, within the faceplate panel 12, in a predetermined spaced relation to the screen 22.

An electron gun 26, shown schematically by the dashed lines in FIG. 1, is centrally mounted within the neck 14, to generate three inline electron beams 28, a center and two side or outer beams, along convergent paths through the shadow mask 25 to the screen 22. The inline direction of the beams 28 is approximately normal to the plane of the paper.

The CRT of FIG. 1, is designed to be used with an external magnetic deflection yoke, such as yoke 30, shown in the neighborhood of the funnel-to-neck junction. When activated, the yoke 30 subjects the three beams 28 to magnetic fields that cause the beams to scan a horizontal and vertical rectangular raster across the screen 22.

Figure 3:
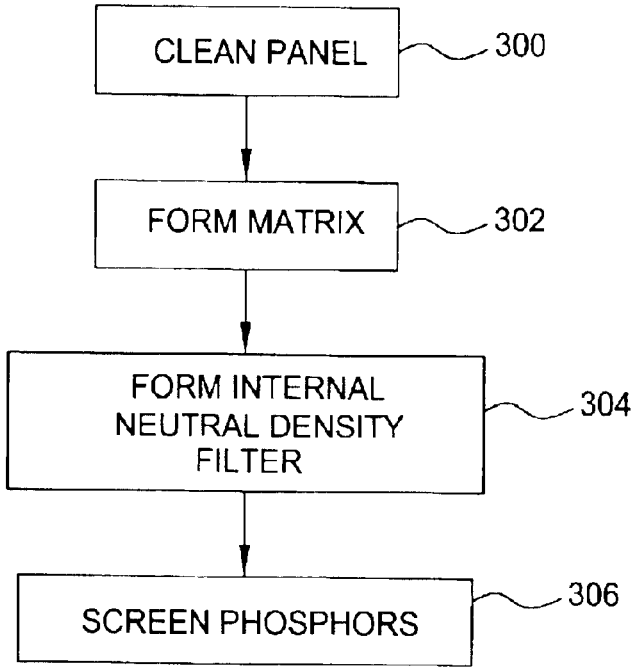
FIG. 3 is a block diagram comprising a flow chart of the manufacturing process for the screen assembly of FIG. 2.

The screen 22 is manufactured according to the process steps represented schematically in FIG. 3. Initially, the faceplate panel 12 is cleaned, as indicated by reference numeral 300, by washing it preferably with a caustic solution, rinsing it in water, etching it with buffered hydrofluoric acid and rinsing it again with water, as is known in the art. The faceplate panel 12 is preferably formed of a high transmission glass (greater than about 80% transmission at wavelengths of 450 nm to 650 nm). The combination of the high transmission glass with the internal neutral density filter provides the desired transmission and reflectance as observed from low transmission glass while avoiding the "Halo" effect.

The interior surface of the faceplate panel 12 is then provided with a light-absorbing matrix 23, as indicated by reference numeral 302, preferably, using a wet matrix process in a manner described in U.S. Pat. No. 3,558,310, issued Jan. 26, 1971 to Mayaud, U.S. Pat. No. 6,013,400, issued Jan. 11, 2000 to LaPeruta et al., or U.S. Pat. No. 6,037,086 issued Mar. 14, 2000 to Gorog et al.

Figure 4A:
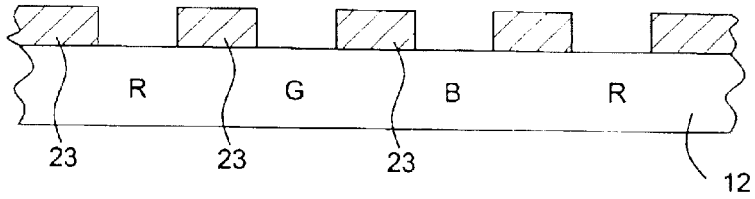
FIGS. 4A–4C depict views of the interior surface of the faceplate panel luminescent screen assembly during internal neutral density filter formation.

The light-absorbing matrix 23 is uniformly provided over the interior viewing surface of faceplate panel 12. For a faceplate panel 12 having a diagonal dimension of about 68 cm (27 inches), the openings formed in the layer of light-absorbing matrix 23 can have a width in a range of about 0.075 mm to about 0.25 mm, and the opaque matrix lines can have a width in a range of about 0.075 mm to about 0.30 mm. Referring to FIG. 4A, the light-absorbing matrix 23 defines three sets of fields: a red field, R, a green field, G, and a blue field, B.

Figure 4B:
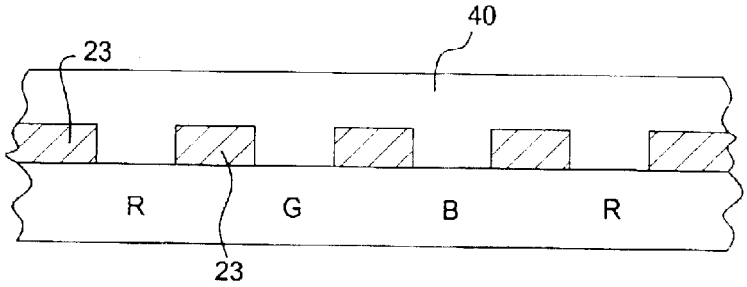

Referring to reference numeral 304 in FIG. 3 as well as FIG. 4B, an internal neutral density filter 40 is applied over the light-absorbing matrix 23 on the interior surface of the faceplate panel 12. The internal neutral density filter 40 may be applied from an aqueous suspension that may comprise blue pigment, red pigment and at least one non-pigmented oxide particle.

The internal neutral density filter functions to decrease the reflection of the screen throughout the panel so as to minimize or eliminate the "Halo" effect of the CRT tube. The particles comprising the neutral density filter should have an average size of about 100 nm (nanometers) in order to reduce excess scattering of phosphor emission from the CRT screen. The particle size also contributes to the formation of uniform filter layers without discontinuities that may result in a decrease in CRT performance.

The internal neutral density filter should include a total pigment weight % of the blue pigment and the red pigment within a range of about 5 weight % to about 12 weight %. The total pigment weight % should include blue pigment within a range of about 4.5 weight % to about 11.6 weight % and red pigment within a range of about 0.15 weight % to about 1.2 weight %. The above-mentioned range for the total pigment content reduces the reflection of ambient light by the faceplate panel when combined with glass of appropriate transmission to a desired level. Varying the ratio of the blue pigment to the red pigment provides the desired optical response of the filter. An effective ratio range of the blue pigment to red pigment has been found to be about 9:1 to about 32:1. The thickness for the internal neutral density filter should be within a range of about 1–2 micrometers.

The blue pigment, for example, may be a $CoO.Al_2O_3$ daipyroxide blue pigment TM-3490E, commercially available from Daicolor-Pope, Inc. of Patterson, N.J. Another suitable blue pigment may include for example, EX1041 blue pigment, commercially available from Shepherd Color Co. of Cincinnati, Ohio, among other pigments.

The blue pigment may be milled using a ball milling process in which the pigment is dispersed along with one or more surfactants in an aqueous suspension. The blue pigment may be ball milled using for example, 1/16 inch $ZrO_2$ balls for at least about 19 hours up to about 72 hours. Preferably, the blue pigment may be ball milled for about 66 hours. The average particle size for the blue pigment was about 120 nm (nanometers) after ball milling.

The red pigment, for example, may be a $Fe_2O_3$ daipyroxide red pigment TM-3875, commercially available from Daicolor-Pope, Inc. of Patterson, N.J. Another suitable red pigment may include, for example, R2899 red pigment, commercially available from Elementis Pigments Co. of Fairview Heights, Ill., among other red pigments.

The red pigment may be milled using a ball milling process in which the pigment is dispersed along with one or more surfactants in an aqueous suspension. The red pigment may be ball milled using for example, 1/16 inch $ZrO_2$ balls for at least about 15 hours up to about 90 hours. Preferably, the red pigment may be ball milled for about 19 hours. The average particle size for the red pigment was about 85 nm after ball milling.

The at least one non-pigmented oxide particle may comprise a material, such as, for example, silica, alumina, or combinations thereof. The at least one non-pigmented oxide particle should have a size comparable to the size of the pigment. Preferably the average size of the at least one non-pigmented oxide particles should be less than about 30 nm. The at least one non-pigmented oxide particle is believed to enhance the adhesion of the filter layer to the faceplate panel. The at least one non-pigmented oxide particle may be present in a concentration of about 5% to about 10% by weight with respect to the total pigment mass.

The internal neutral density filter may also include one or more surface-active agents such as, for example, organic and polymeric compounds that may optionally adopt an electric charge in aqueous solution. The surface-active agent may comprise, anionic, non-ionic, cationic, and/or amphoteric materials. The surface-active agent may be used for various functions such as improving the homogeneity of the pigment in the aqueous pigment suspension, stabilization of nanoparticles, improved wetting of the faceplate panel, among other functions. Examples of suitable surface-active agents include various polymeric dispersants such as, for example, DISPEX N-40V and A-40 polymeric dispersants (commercially available from Ciba Specialty Chemicals of High Point, N.C.) as well as block copolymer surface active agents such as Pluronic Series (ethoxypropoxy co-polymers) L-62, commercially available from Hampshire Chemical Company of Nashua, N.H., and carboxymethyl cellulose (CMC) commercially available from Yixing Tongda Chemical Co. of China.

The aqueous suspension may be applied to the faceplate panel by, for example, spin coating in order to form the internal neutral density filter 40 over the light-absorbing matrix 23 on the interior surface of the faceplate panel 12. The spin-coated internal neutral density filter 40 may be heated to a temperature within a range from about 60° C. to about 90° C. to provide increased adhesion of the internal neutral density filter 40 to the faceplate panel 12.

Figure 4C:
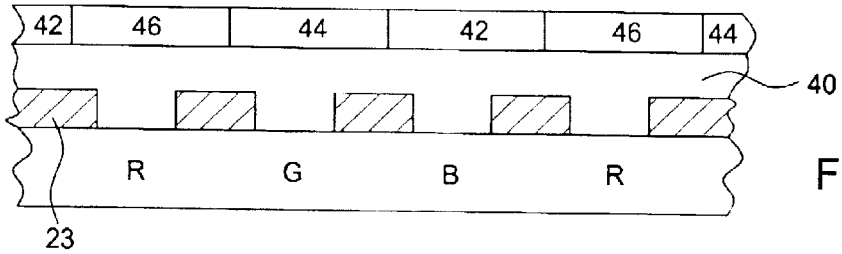

Referring to reference numeral 306 in FIG. 3 as well as FIG. 4C, the faceplate panel 12 is screened with green phosphors 42, blue phosphors 44, and red phosphors 46, preferably using a screening process in a manner known in the art.

Phosphor adherence to the internal neutral density filter may be improved by modifying the conventional process parameters to have an increased exposure energy in the light-house and/or changing the development parameters. For example, an internal neutral density filter coated faceplate panel may use a higher slurry drying temperature, a higher exposure time, a lower developer pressure and/or a shorter development time than a standard uncoated faceplate panel when the phosphors are applied thereto.

Alternatively, a pre-coat layer may be applied over the internal neutral density filter prior to screening the phosphors. The pre-coat layer should form an interface on the internal neutral density filter to which the phosphor layer can adhere. The pre-coat layer may include for example, polyvinyl alcohol (PVA) as well as functionalized silanes, silanols and siloxanes.

By way of example, an aqueous pigment blend to be used for the internal neutral density filter was prepared. The pigment blend comprised a blue pigment suspension, a red pigment suspension and a silica suspension.

The blue pigment suspension was prepared by placing 190 grams of water, 8 grams of a polymeric dispersant DISPEX N-40 (commercially available from Ciba Specialty Chemicals of High Point, N.C.) and 50 grams of TM-3480 Daipyroxide blue pigment (commercially available from Daicolor-Pope, Inc. of Patterson, N.J.) in a ball mill. The blue pigment suspension was ball milled using 1/16-inch zirconium oxide balls for 66 hours to form a blue pigment concentrate. The average particle size of the blue pigment in the suspension was 120 nm after ball milling. The recovered blue pigment suspension had a solid content of about 20 weight % which was diluted to about 14 weight % with de-ionized water.

The red pigment suspension was prepared by placing 190 grams of water, 8 grams of a polymeric dispersant DISPEX A-40 (commercially available from Ciba Specialty Chemicals of High Point, N.C.) and 50 grams of TM-3875 Daipyroxide red pigment (commercially available from Daicolor-Pope, Inc. of Patterson, N.J.) in a ball mill. The red pigment suspension was ball milled using 1/16-inch zirconium oxide balls for 19 hours to form a red pigment concentrate. The average particle size of the red pigment in the suspension was 85 nm after ball milling. The recovered red pigment suspension had a solid content of about 20 weight % which was diluted to about 10 weight % with de-ionized water.

The silica suspension utilized was SNOWTEX S (commercially available from Nissan Chemical Industries of Tokyo, Japan). The silica suspension had a solid content of about 30 weight % and an average particle size of 7–9 nm.

A 1000 gram pigment blend containing 611 grams of the blue pigment suspension at 14 weight %, 45 grams of the red pigment suspension at 10 weight % and 20.6 grams of the silica suspension, with the remaining mass added as de-ionized water was prepared.

The pigment blend was mixed for about 10 minutes and thereafter applied to a high transmission glass panel (greater than about 80% transmission at wavelengths of 450 nm to 650 nm) such as the faceplate panel 12, described above with reference to FIG. 4B. The panel had a light-absorbing matrix layer, similar to the light-absorbing matrix 23, described above with respect to FIG. 4A. The pigment blend was applied to the faceplate panel at a temperature of about 30° C. and then the coated panel was spun at a speed of about 80 rpm at an angle of 95° for about 20 seconds. The faceplate panel was then heated to 65° C. and cooled to 34° C.

Figure 5:
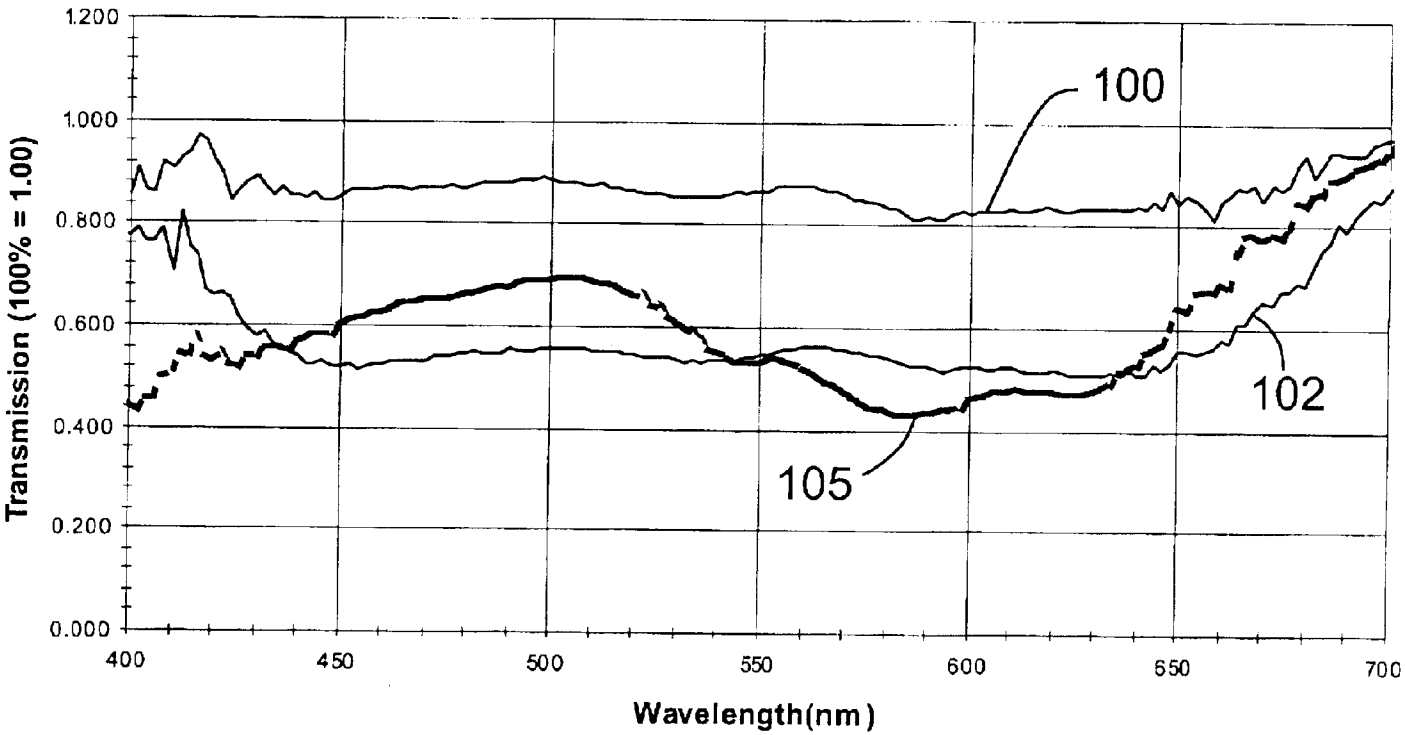
FIG. 5 is a plot showing transmission plotted as a function of wavelength of a high transmission glass panel, a high transmission glass panel coated with an internal neutral density filter and a low transmission glass panel.

Transmission performance was measured for the faceplate panel prepared above as compared to an uncoated high transmission glass panel (greater than about 80% transmission at wavelengths of 450 nm to 650 nm) and a low transmission glass panel (about 50% transmission at wavelengths of 450 nm to 650 nm). Referring to FIG. 5, an internal neutral density filter coated high transmission glass panel 105 had a lower transmission than that of the uncoated high transmission glass panel 100 at wavelengths in a range of about 550 nm to about 650 nm. The internal neutral density filter coated high transmission glass panel 105 had a transmission that matched that of low transmission glass panel 102 at a wavelength of 550 nm. This wavelength depicts the midpoint of the spectral region of interest in that it is the highpoint of green phosphor emission and the high point of the photo-optic response.

Alternatively, the pigment blend may be applied by adjusting the application parameters, such as for example, the speed of rotation and the tilt angle of the faceplate panel during rotation. By way of example, the pigment blend may be applied to the faceplate panel at a temperature of about 30° C. and spun at a speed of 8 rpm and an angle of 10° for about 10 seconds. The panel is tilted to an angle of 25° over a period of about 20 seconds and spun at 8 rpm for about 30 seconds. The panel is tilted to an angle of 950 over a period of about 3 seconds and then spun at 80 rpm for about 20 seconds. The faceplate panel was then heated to at least 65° C., spun at a speed of 15 rpm and an angle of 950 for about 380 seconds.

What is claimed is:

1. A cathode-ray tube having a luminescent screen assembly, comprising:

a faceplate panel having a patterned light-absorbing matrix thereon; and an internal neutral density filter, wherein the internal neutral density filter comprises at least two pigments and at least one non-pigmented oxide particle, and wherein the at least two pigments are present in a concentration within a range of about 5 weight % to about 12 weight %.

2. The cathode-ray tube of claim 1 wherein the at least two pigments include a blue pigment and a red pigment.

3. The cathode-ray tube of claim 2 wherein the ratio of the blue pigment to red pigment is within a range of about 9:1 to about 32:1.

4. The cathode-ray tube of claim 2 wherein the blue pigment comprises $CoO.Al_2O_3$ daipyroxide blue.

5. The cathode-ray tube of claim 2 wherein the red pigment comprises $Fe_2O_3$ daipyroxide red.

6. The cathode-ray tube of claim 1 wherein the at least two pigments have an average particle size of about 100 nanometers.

7. The cathode-ray tube of claim 1 further comprising a pre-coat layer is formed on the internal neutral density filter.

8. The cathode-ray tube of claim 7 wherein the pre-coat layer comprises a material selected from the group consisting of polyvinyl alcohol, functionalized silanes, silanol and siloxane.

* * * * *